US010888922B2

(12) United States Patent
Suehara et al.

(10) Patent No.: US 10,888,922 B2
(45) Date of Patent: Jan. 12, 2021

(54) CASTING APPARATUS AND CASTING METHOD

(71) Applicant: HITACHI METALS, LTD., Tokyo (JP)

(72) Inventors: Kiyoshi Suehara, Moka (JP); Hidenori Takahashi, Kumagaya (JP); Toru Iwanaga, Moka (JP); Yutaka Morita, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 246 days.

(21) Appl. No.: 15/772,625

(22) PCT Filed: Nov. 2, 2016

(86) PCT No.: PCT/JP2016/082686
§ 371 (c)(1),
(2) Date: May 1, 2018

(87) PCT Pub. No.: WO2017/078104
PCT Pub. Date: May 11, 2017

(65) Prior Publication Data

US 2019/0118254 A1 Apr. 25, 2019

(30) Foreign Application Priority Data

Nov. 4, 2015 (JP) ..... 2015-216415

(51) Int. Cl.
*B22D 18/04* (2006.01)
*B22D 27/13* (2006.01)
(Continued)

(52) U.S. Cl.
CPC ..... *B22D 27/13* (2013.01); *B22D 18/04* (2013.01); *B22D 35/04* (2013.01); *B22D 41/58* (2013.01); *B22D 47/00* (2013.01)

(58) Field of Classification Search
CPC ..... B22D 18/04; B22D 27/09; B22D 27/13; B22D 47/00; B22D 37/00
See application file for complete search history.

(56) References Cited

U.S. PATENT DOCUMENTS 6,460,600 B1 * 10/2002 Wuepper ..... B22D 47/00 164/130
2009/0151887 A1 6/2009 Goka
(Continued)

FOREIGN PATENT DOCUMENTS

JP 60154867 A * 8/1985 ..... B22D 37/00
JP 09122887 A * 5/1997 ..... B22D 27/13
(Continued)

OTHER PUBLICATIONS

EPO machine translation of JP 2015-000404 (Year: 2015).*
International Search Report for PCT/JP2016/082686 dated Jan. 31, 2017.

*Primary Examiner* — Kevin E Yoon
(74) *Attorney, Agent, or Firm* — Sughrue Mion, PLLC

(57) ABSTRACT

A casting apparatus for producing castings using molds each having a sprue, comprising a mold-conveying means for conveying molds each containing a melt poured through the sprue; nozzles each having a gas-introducing opening attachable to and detachable from the sprue; nozzle-attaching/detaching means each moving each nozzle to attach and detach the gas-introducing opening to and from the sprue; moving means for moving the nozzle-attaching/detaching means, such that the nozzle-attaching/detaching means moves following a mold conveyed by the mold-conveying means, while keeping the connection of the gas-introducing opening to the sprue by the nozzle-attaching/detaching means; and a gas supply means connected to each nozzle for supplying a gas to the gas-introducing opening.

9 Claims, 4 Drawing Sheets

(51) Int. Cl.

| | |
|---|---|
| ***B22D 27/09*** | (2006.01) |
| ***B22D 47/00*** | (2006.01) |
| ***B22D 35/04*** | (2006.01) |
| ***B22D 41/58*** | (2006.01) |

(56) References Cited

U.S. PATENT DOCUMENTS

| | | | |
|---|---|---|---|
| 2010/0324719 | A1 | 12/2010 | Ota et al. |
| 2016/0136726 | A1 | 5/2016 | Watanabe et al. |
| 2016/0236274 | A1 | 8/2016 | Kawabata et al. |
| 2017/0326636 | A1 | 11/2017 | Nishida et al. |

FOREIGN PATENT DOCUMENTS

| | | | |
|---|---|---|---|
| JP | 2007-075862 | A | 3/2007 |
| JP | 2009-297783 | A | 12/2009 |
| JP | 2015000404 | A | 1/2015 |
| WO | 2014/203956 | A1 | 12/2014 |
| WO | 2015/046615 | A1 | 4/2015 |
| WO | 2016/084154 | A1 | 6/2016 |

* cited by examiner

CASTING APPARATUS AND CASTING METHOD

CROSS REFERENCE TO RELATED APPLICATIONS

This application is a National Stage of International Application No. PCT/JP2016/082686 filed Nov. 2, 2016, claiming priority based on Japanese Patent Application No. 2015-216415 filed Nov. 4, 2015.

FIELD OF THE INVENTION

The present invention relates to a casting apparatus for producing castings using molds each having a sprue, and a casting method using such a casting apparatus.

BACKGROUND OF THE INVENTION

In gravity casting using a mold such as a sand mold, etc., a cast article is formed by pouring a melt into a cavity of the mold. In such a casting method, cavity portions other than a product cavity portion for forming a cast article, namely non-product cavity portions such as a sprue, a runner, a riser, etc., which need not be filled with a melt, are conventionally charged with a melt, for example, to prevent shrinkage cavities. However, to meet recent request of reducing environmental loads such as $CO_2$ emission, energy consumption, etc., investigation has been conducted to provide methods for improving a pouring yield (mass of cast product/mass of poured melt) by reducing the amount of a melt filling a sprue, a runner, etc., thereby reducing the amount of a melt necessary for casting.

As an example of such methods, WO 2014/203956 A discloses a casting method comprising introducing a melt in an amount less than the volume of an entire cavity of a mold and equal to or more than the volume of a product cavity portion into the cavity through a sprue, connecting a gas-introducing opening to the sprue of the mold before the melt is solidified, and introducing a gas into the cavity through the gas-introducing opening, so that the melt introduced into the cavity is charged into the product cavity portion by pressure (dynamic pressure) generated in the cavity. This method may be called "gas-introducing casting method" below. Because a melt in an amount less than the volume of the entire cavity is charged into the product cavity portion by a gas and solidified in this gas-introducing casting method, the amount of a melt solidified in other cavity portions than the product cavity portion, such as a sprue, a runner, a riser, etc. can be reduced, resulting in an improved pouring yield.

When the gas-introducing casting method described in WO 2014/203956 A is conducted by a conventional casting apparatus for mass producing castings by successively conveying melt-poured molds from a melt-pouring area, the gas-introducing opening may be detached from the sprue by inertia applied to the gas-introducing opening due to increase or decrease of the moving speed of each mold being conveyed, resulting in the leak of a gas introduced through the gas-introducing opening. This leak leads to insufficient pressure (dynamic pressure) of the gas introduced into the cavity, so that a melt insufficiently charged into the product cavity portion is solidified, or that a melt once charged into the product cavity portion is reversed, resulting in insufficient filling. As a result, the castings may suffer defects such as underfills, etc.

OBJECT OF THE INVENTION

An object of the present invention made to solve the above problems is to provide a casting apparatus capable of mass-producing castings having good quality while reducing the amount of a melt necessary for casting, and a casting method using such a casting apparatus.

DISCLOSURE OF THE INVENTION

The casting apparatus of the present invention for producing castings using molds each having a sprue comprises a mold-conveying means for conveying molds each containing a melt poured through the sprue;

nozzles each having a gas-introducing opening attachable to and detachable from the sprue;

nozzle-attaching/detaching means each moving each nozzle to attach and detach the gas-introducing opening to and from the sprue;

moving means for moving the nozzle-attaching/detaching means, such that the nozzle-attaching/detaching means moves following a mold conveyed by the mold-conveying means, while keeping the connection of the gas-introducing opening to the sprue by the nozzle-attaching/detaching means; and a gas supply means connected to each nozzle for supplying a gas to the gas-introducing opening.

In the casting apparatus, the nozzle is preferably connected to the nozzle-attaching/detaching means, via a universal joint elastically displaceable in a direction of conveying the molds by the mold-conveying means.

In the casting apparatus, a nozzle-position-detecting means capable of detecting the displacement of the nozzle by the universal joint is preferably mounted to the nozzle-attaching/detaching means, to control the movement of the moving means such that the position of the nozzle detected by the nozzle-position-detecting means is within a predetermined range from a reference position.

The casting apparatus preferably comprises pluralities of gas supply units each constituted by a set of the nozzle, the nozzle-attaching/detaching means and the moving means. It is more preferable that pluralities of molds are successively conveyed by the mold-conveying means, and each of the gas supply units is successively operated for each of the molds.

The casting apparatus preferably further comprises a melt-surface-detecting means for detecting the lowered degree of a surface of a melt poured through the sprue; the gas-introducing opening being connected to the sprue when the lowered surface level detected by the melt-surface-detecting means exceeds a threshold value.

The casting method of the present invention for producing castings using molds each having a sprue comprises a step of connecting a gas-introducing opening to a sprue of a mold into which a melt has been poured;

a step of conveying the mold to which the gas-introducing opening is connected, while introducing a gas into the mold through the gas-introducing opening; and a step of detaching the gas-introducing opening from the sprue;

wherein in the conveying step, the gas-introducing opening connected to the sprue moves following the mold being conveyed.

In the connecting step of the casting method, the gas-introducing opening is preferably connected to the sprue after a surface of a melt poured through the sprue is lowered to a predetermined height.

In the conveying step of the casting method, the absolute value of acceleration of vertical vibration received by the mold is preferably 19.6 $m/s^2$ or less.

In the casting method, a reaction force generated by pushing the gas-introducing opening to the sprue for connection in the conveying step is preferably 600 N or less.

EFFECTS OF THE INVENTION

The present invention can provide a casting apparatus capable of mass-producing castings having good quality with a reduced amount of a melt necessary for casting, and a casting method using such a casting apparatus.

DESCRIPTION OF THE PREFERRED EMBODIMENTS

[1] Casting Apparatus

An embodiment of the casting apparatus of the present invention will be described below referring to the attached drawings. It should be noted that the present invention is not restricted to the embodiments described below, but proper modifications can be made within the scope of the present invention.

(1) Overall Structure

Figure 1:
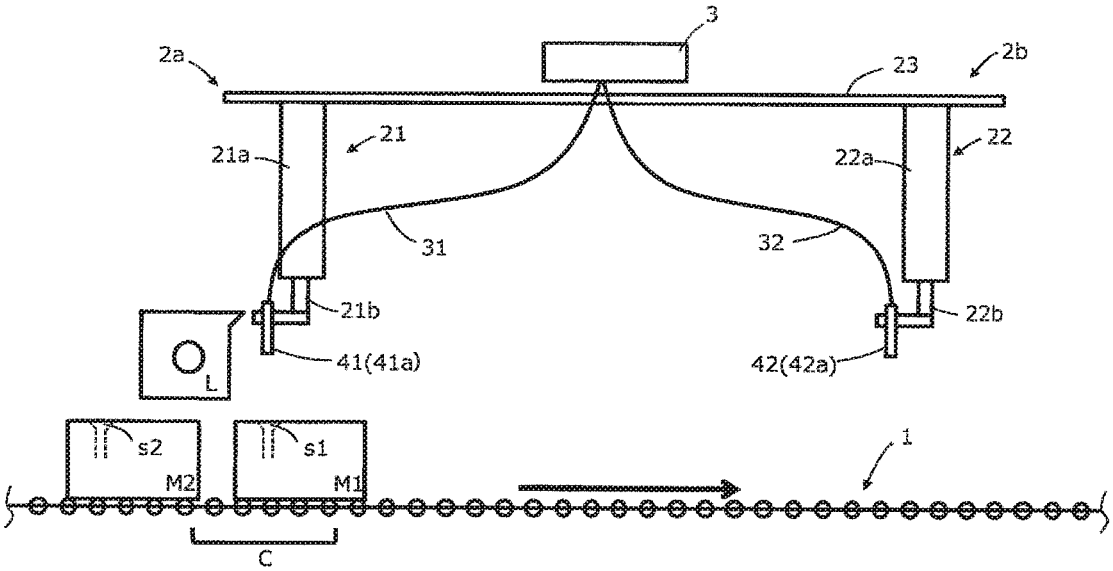
FIG. 1 is a schematic view showing an example of the casting apparatuses of the present invention.

The embodiment shown in FIG. 1 is directed to a casting apparatus for producing castings by using molds M1 (M2). Each mold M1 (M2) comprises a cavity comprising a sprue s1 (s2); non-product cavity portions (not shown) including a runner, a riser, a gate, etc., which are connected to the sprue s1 (s2); and a product cavity portion (not shown) for forming a cast product. In the casting apparatus using a gas-introducing casting method in this embodiment, casting is conducted by pouring a melt in an amount of smaller than the total volume of the overall cavity including the sprue s1 (s2), the non-product cavity portions and the product cavity portion and equal to or more than the volume of the product cavity portion, through the sprue s1 (s2).

The casting apparatus comprises a mold-conveying means 1 for conveying molds M1 (M2) each containing a melt poured through a sprue s1 (s2), and nozzles 41 (42) each having at a lower end a gas-introducing opening 41*a* (42*a*) attachable to and detachable from the sprue s1 (s2). This nozzle 41 (42) is fixed to a nozzle-attaching/detaching means 21*b* (22*b*), which is connected to a moving means 21*a* (22*a*). The nozzle-attaching/detaching means 21*b* (22*b*) is moved by the moving means 21*a* (22*a*) in the direction of conveying the molds M1 (M2) on the mold-conveying means 1. Each nozzle 41 (42) is connected to a gas supply means 3 for supplying a gas ejected from the gas-introducing opening 41*a* (42*a*), via a gas supply pipe 31 (32).

In this embodiment, both nozzle-attaching/detaching means 21*b* (22*b*) and moving means 21*a* (22*a*) are assembled in body portions 21 (22). A set of three constituent parts, the nozzle 41 (42), the nozzle-attaching/detaching means 21*b* (22*b*) and the moving means 21*a* (22*a*), constitute a gas supply unit 2*a* (2*b*). The casting apparatus in this embodiment comprises two sets (plural sets) of gas supply units 2*a* (2*b*), suitable for mass production. FIG. 1 shows a melt-pouring area C having a pouring device (ladle) L on the upstream side of the casting apparatus as part of a casting line comprising the casting apparatus. Though not depicted, this casting line usually comprises a molding apparatus on the upstream side and a casting takeout apparatus on the downstream side.

Constituent parts in the casting apparatus in this embodiment will be explained in detail below. Because two sets of the gas supply units 2*a* (2*b*) have basically the same structure, only the structure of a gas supply unit 2*a* on the left side in FIG. 1 will be explained, with the explanation of a gas supply unit 2*b* on the right side omitted.

(2) Mold-Conveying Means

The mold-conveying means 1 conveys the molds M1 (M2) each containing a melt poured in the melt-pouring area C to the downstream side. Though the molds M1 (M2) may be conveyed separately, they are preferably conveyed successively in the order of M1, M2, . . . after the completion of melt pouring, for mass production. In this embodiment, the mold-conveying means 1 is a roller conveyer arranged horizontally in the conveying direction of the molds M1 (M2), such that the molds M1 (M2) on the roller conveyer can be conveyed successively. By a control means (not shown) connected to the mold-conveying means 1, the molds M1 (M2) can be conveyed according to a predetermined conveying profile (for example, a profile based on the relation of the position and moving speed of each mold to the time lapse after melt pouring). After a melt is poured into the mold M1 (M2) conveyed to a pouring position in the melt-pouring area C, the gas-introducing opening 41*a* (42*a*) of the nozzle 41 (42) is connected to the mold M1 (M2), and the mold M1 (M2) is then conveyed at a predetermined speed. The control means may be, for example, a computer comprising CPU, memory and I/O.

(3) Gas Supply Unit: Nozzle, Nozzle-Attaching/Detaching Means and Moving Means

The gas supply unit 2*a* comprises a body portion 21 comprising a nozzle 41, a vertically movable nozzle-attaching/detaching means 21*b*, and a horizontally moving means 21*a* which engages a rail (guide member) 23. The nozzle-attaching/detaching means 21*b* supports the nozzle 41 having a gas-introducing opening 41*a* at a lower end. The rail 23 horizontally extends above the mold-conveying means 1 in the conveying direction of the molds M1 (M2), such that the moving means 21*a* can horizontally move with the conveyed molds M1 (M2). The rail 23 is arranged such that the moving means 21*a* and 21*b* can move without interference. The gas supply unit 2*a* need only comprise at least a nozzle 41, a nozzle-attaching/detaching means 21*b* and a moving means 21*a*, but may comprise other constituent parts such as a sensor if necessary. At least one of the nozzle-attaching/detaching means 21*b* and the moving means 21*a*, or the entire gas supply unit 2*a* including the nozzle 41 may be constituted by a multi-axis, multi joint robot, etc.

With the gas-introducing opening 41*a* at the lower end connected to the sprue s1 (s2) of the mold M1 (M2), the nozzle 41 introduces a gas into a cavity of the mold M1 (M2). As shown in FIG. 1, the gas-introducing opening 41*a* of the nozzle 41 having substantially the same diameter as that of the sprue s1 (s2) is in a shape fit into the sprue s1 (*s*2). However, the shape of the nozzle 41 is not particularly restricted, as long as the nozzle 41 can be connected to the sprue s1 (s2) to introduce a gas into the cavity of the mold M1 (M2) without leak. For example, the gas-introducing opening 41*a* may be provided with a flange member surrounding an opening of the sprue s1 (s2), such that it can be pressed to the mold M1 (M2). Also, the nozzle 41 may be tapered toward the gas-introducing opening 41*a*, such that it can be press-fit into the sprue s1 (s2).

The horizontal movement of the moving means 21*a* and the vertical movement of the nozzle-attaching/detaching means 21*b* are controlled by a control means (not shown) connected to them. Specifically, the control means can control the position and moving speed of the moving means 21*a* during horizontal movement along the rail 23, and the vertical position and moving speed of the nozzle-attaching/detaching means 21*b*. This control of the movement of the moving means 21*a* and the vertical movement of the nozzle-attaching/detaching means 21*b* enables a series of operation comprising moving the nozzle 41 with a melt-poured mold M1 (M2) with its gas-introducing opening 41*a* connected to the sprue s1 (s2) of the mold M1 (M2), and detaching the gas-introducing opening 41*a* from the sprue s1 (s2).

The control of the movement of the moving means 21*a* and the vertical movement of the nozzle-attaching/detaching means 21*b* will be explained in further detail. The control means connected to the moving means 21*a* and the nozzle-attaching/detaching means 21*b* can control the moving means 21*a* and the nozzle-attaching/detaching means 21*b*, according to a conveying profile of the mold-conveying means 1 and the position data of the sprue s1 (s2) of the M1 (M2) being conveyed, such that the gas-introducing opening 41*a* of the nozzle 41 supported by the nozzle-attaching/detaching means 21*b* can be connected to the sprue s1 (s2) of the mold M1 (M2) with predetermined timing. With such control, the gas-introducing opening 41*a* of the nozzle 41 can be precisely connected to the sprue s1 (s2) of the melt-poured mold M1 (M2).

The vertical movement of the nozzle-attaching/detaching means 21*b* is preferably carried out to obtain a predetermined reaction force generated by pressing the nozzle 41 to the mold M1 (M2) or the sprue s1 (s2). When the reaction force generated by pressing is too large, the nozzle 41 or the sprue s1 (s2) may be damaged, causing gas leak and thus likely failing to introduce a gas into the cavity of the mold M1 (M2) at sufficient pressure. On the other hand, when the reaction force generated by pressing is too small, the gas-introducing opening 41*a* of the nozzle 41 is easily detached from the sprue s1 (s2), causing gas leak and thus likely failing to introduce a gas into the cavity of the mold M1 (M2) at sufficient pressure.

The control means preferably controls the movement of the moving means 21*a* and the nozzle-attaching/detaching means 21*b*, according to the position information of the mold M1 (M2) conveyed by the mold-conveying means 1. Thus, the nozzle 41 supported by the nozzle-attaching/detaching means 21*b* can move following the mold M1 (M2) being conveyed, while keeping good connection of the gas-introducing opening 41*a* to the sprue s1 (s2). As a result, even when inertia is applied to the gas-introducing opening 41*a* by increase or decrease of the moving speed of the mold M1 (M2), the gas-introducing opening 41*a* is not easily detached from the sprue s1 (s2), thereby suppressing pressure decrease in the cavity of the mold M1 (M2) due to gas leak.

When open control is conducted using a conveying profile of the mold-conveying means 1 as the position information of the molds M1, M2, . . . being conveyed, discrepancy may be generated between the positions of the molds M1 (M2) in the conveying profile and the actual positions of the molds M1 (M2) being conveyed, thereby making it difficult that the nozzle 41 moves following the mold M1 (M2). Accordingly, it is preferable to use the actually measured position information of the molds M1 (M2) being conveyed, and feedback this measured position information to carry out closed control of the movement of the moving means 21*a*.

As the measured position information of the molds M1 (M2), for example, the measured positional relation of the conveyed molds M1 (M2) to the mold-conveying means 1 can be used. However, to shorten the distance to be measured to minimize the influence of dust and fume around the casting apparatus, it is more preferable to use the measured positional relation of the conveyed molds M1 (M2) to the moving means 21*a*. This provides more accurate measured position information of the molds M1 (M2). A way of obtaining the measured position information is not particularly restricted, but it can be obtained, for example, by measuring the distance from the moving means 21*a* to each mold M1 (M2) by a laser distance meter attached as a mold-position-measuring means to the moving means 21*a*.

When the positional relation (distance) between the mold M1 (M2) being conveyed and the moving means 21*a* is used as the measured position information, the moving speed of the moving means 21*a* is desirably adjusted by the control means to keep the positional relation of the moving means 21*a* and the mold M1 (M2) both moving within a predetermined range. The control of the moving speed of the moving means 21*a* may be adjusted by usual PID control using the measured position information as input information.

Figure 8:
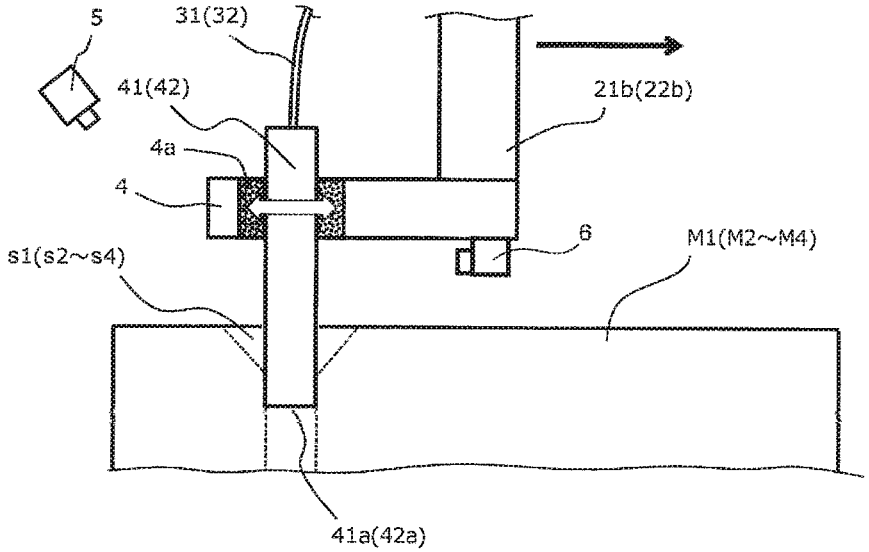
FIG. 8 is a partial, enlarged schematic view showing the casting apparatus of FIG. 1.

As shown in FIG. 8, the nozzle-attaching/detaching means 21*b* preferably supports the nozzle 41 via a universal joint 4 elastically displaceable in the conveying direction of the molds M1 (M2) on the mold-conveying means 1 (in a horizontal direction in this embodiment). The universal joint 4 comprises an elastic body 4*a* elastically deformable in the conveying direction of the molds M1 (M2), by which the nozzle 41 can slightly swing back and forth in the conveying direction of the molds M1 (M2). Accordingly, even when the nozzle 41 cannot move completely following the mold M1 (M2) due to increase or decrease of its conveying speed, resulting in their position difference, such position difference can be absorbed by the deformation of the elastic body 4*a* contained in the universal joint 4, thereby avoiding a gap between the gas-introducing opening 41*a* of the nozzle 41 and the sprue s1 (s2) to prevent gas leak.

When the nozzle 41 is supported via the elastically displaceable universal joint 4 as described above, as shown in FIG. 8, a nozzle-position-detecting means 6 for detecting the conveying-direction displacement of the nozzle 41 by the universal joint is more preferably mounted to the nozzle-attaching/detaching means 21*b* to control the movement of the moving means 21*a*, so that the position of the nozzle 41 detected by the nozzle-position-detecting means 6 is within a predetermined range from the reference position. Thus, when the nozzle gas-introducing opening 41*a* is connected to the sprue s1 (s2), the moving speed of the moving means 21*a* shown in FIG. 1 can be adjusted, using the measured position information of the nozzle 41 detected by the nozzle-position-detecting means 6, in place of the measured position information of the mold M1 (M2) per se.

Openings of the sprues s1 (s2) of the molds M1 (M2) are not necessarily located at strictly the same position because of unevenness of the step of forming molds M1 (M2) by a molding apparatus (not shown), but the above structure can cancel the deviated connecting positions to the nozzle 41 due to uneven opening positions of the sprues s1 (s2) formed by the molding apparatus. Also, because this structure can minimize the distance to be measured, resulting in less influence by dust and fume around the casting apparatus, the nozzle-position-detecting means 6 provides high distance measurement accuracy. Thus, a gap is less provided between the gas-introducing opening 41*a* of the nozzle 41 and the sprue s1 (s2) during conveying the mold, thereby further suppressing gas leak.

The above adjustment of the moving speed of the moving means 21 using the measured position information of the nozzle 41 may be combined with the adjustment of the moving speed of the moving means 21*s* according to the conveying profile and measured position information of the molds M1 (M2) per se. This further reduces a gap between the gas-introducing opening 41*a* of the nozzle 41 and the sprue s1 (s2) during conveying the mold, enabling increase in the conveying speed of molds and thus decrease in the production tact.

(4) Gas Supply Means

The gas supply means 3 introduces a gas into the cavity of the mold M1 (M2) through the gas-introducing opening 41*a* (42*a*) of the nozzle 41 (42). Specifically, the gas supply means 3 is connected to the nozzle 41 (42) via a gas supply pipe 31 (32), such that a gas supplied from the gas supply means 3 is sent to the nozzle 41 (42) via the gas supply pipe 31 (32), and then introduced into the cavity of the mold M1 (M2) through the gas-introducing opening 41*a* (42*a*). The gas supply means 3 can preferably supply a gas while adjusting the pressure (dynamic pressure) generated in each cavity of each mold M1 (M2) due to the supplied gas. For example, a compressor or a pressure tank is used as a gas source, and the gas supply pipe 31 (32) is provided with a flow-rate-adjusting valve, a pressure-adjusting valve, etc. Though it is not particularly restricted whether an oxidizing gas or a non-oxidizing gas is used as the gas supplied, the use of air is advantageous for cost reduction.

Though the effects of the present invention can be obtained by providing the casting apparatus of the present invention with a gas supply unit 2*a* described above, the use of two (plural) gas supply units 2*a* and 2*b* as in this embodiment is preferable for the mass production of castings. Plural (two in this embodiment) gas supply units 2*a* and 2*b* can preferably be operated successively one by one to plural molds M1, M2 successively conveyed by the mold-conveying means 1. The casting apparatus in this embodiment comprising two gas supply units 2*a* and 2*b* are used in a casting method explained below.

(5) Other Structure

The casting apparatus preferably further comprises a melt-surface-detecting means 5 for detecting the lowered degree of a surface of a melt poured into the cavity of the mold M1 (M2) through the sprue s1 (s2). When the lowered degree of a melt surface detected by the melt-surface-detecting means 5 exceeds a threshold value, the gas-introducing opening 41*a* (42*a*) of the nozzle 41 (42) is connected to the sprue s1 (s2) (see FIG. 8). With the melt-surface-detecting means 5, a melt poured into the cavity can be prevented from stagnating, thereby suppressing misrun, etc. The melt-surface-detecting means 5 is connected to the control means connected to the nozzle-attaching/detaching means 21*b* (22*b*), and may be constituted by a laser distance meter or an optical or thermosensitive camera, etc. The lowered degree of a melt surface detected by the melt-surface-detecting means 5 can be determined by the measured distance from the laser distance meter to the melt surface when the laser distance meter is used, or by the lowered level of a melt surface calculated from the measured melt surface area when the camera is used. The above melt surface means an exposed upper surface of a melt poured into the cavity of the mold M1 (M2) through the sprue s1 (s2).

[2] Casting Method

A casting method using the casting apparatus in the above embodiment, namely the casting method of the present invention for producing castings using molds each having a sprue, will then be explained. The casting method of the present invention comprises a step of connecting a gas-introducing opening to a sprue of a mold into which a melt has been poured; a step of conveying the mold to which the gas-introducing opening is connected, while introducing a gas into the mold via the gas-introducing opening; and a step of detaching the gas-introducing opening from the sprue; the gas-introducing opening connected to the sprue moving following the mold being conveyed in the conveying step. Its detailed explanation will be made below.

As shown in FIG. 1, a mold M1 is first moved by the mold-conveying means 1 to a pouring position in the melt-pouring area C. The moving means 21*a* of the gas supply unit 2*a* is moved upstream along the rail 23, and the nozzle 41 supported by the nozzle-attaching/'detaching means 21*b* is moved to a position above the mold M1.

Figure 2:
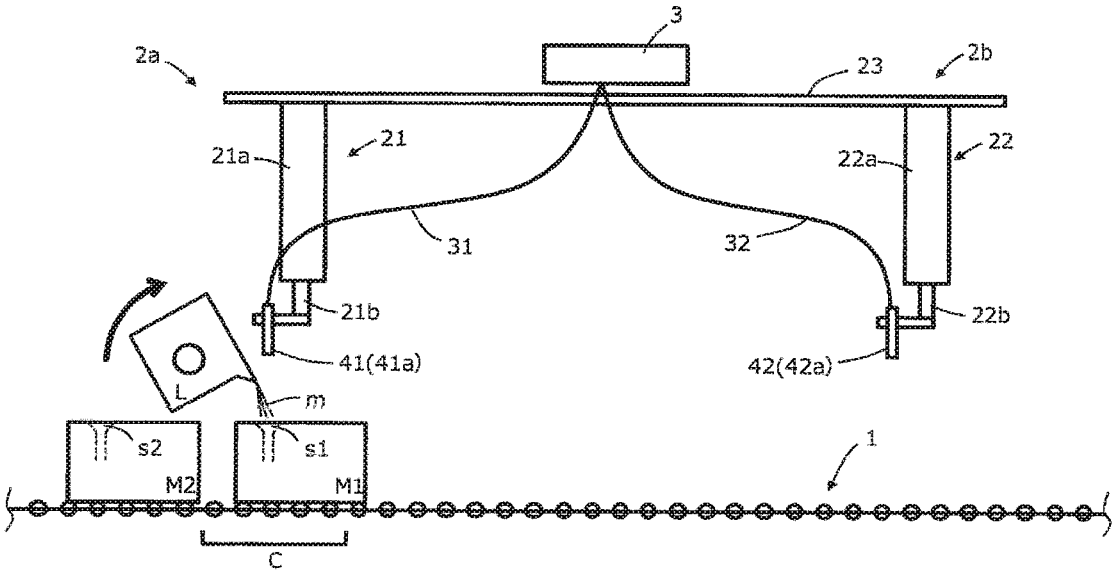
FIG. 2 is a schematic view showing the casting apparatus of the present invention, which is operated from the state of FIG. 1.

As shown in FIG. 2, a ladle L is then inclined at the pouring position in the melt-pouring area C, to pour a melt m in an amount less than the volume of the entire cavity of the mold M1 and equal to or more than the volume of the product cavity portion, from the ladle L into the cavity of the mold M1 through the sprue s1.

Figure 3:
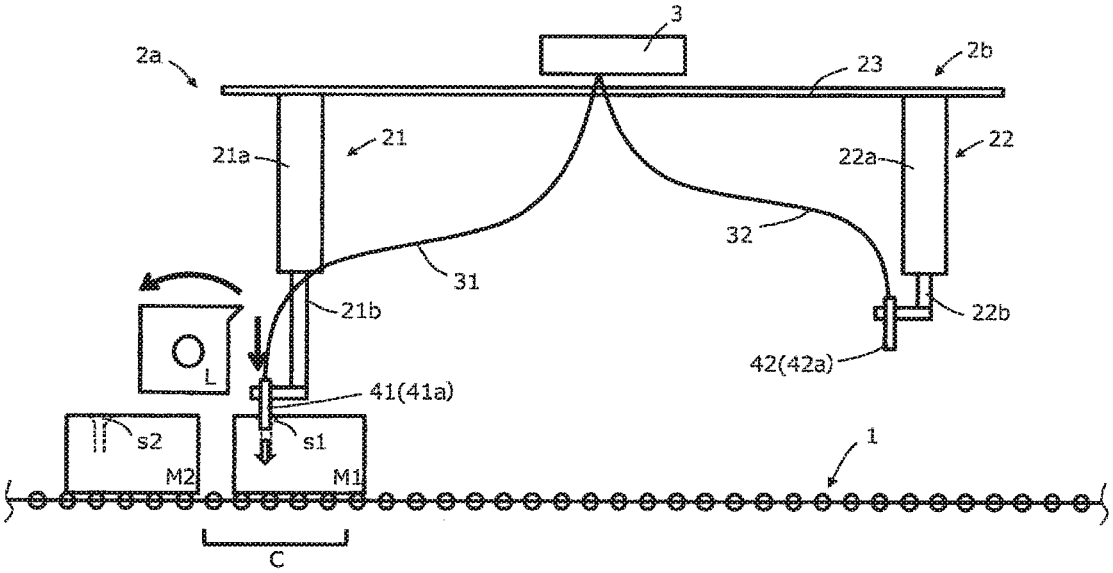
FIG. 3 is a schematic view showing the casting apparatus of the present invention, which is operated from the state of FIG. 2.

As shown in FIG. 3, the nozzle-attaching/detaching means 21*b* of the gas supply unit 2*a* is then moved downward to connect the gas-introducing opening 41*a* of the nozzle 41 to the sprue s1 of the mold M1 (connecting step). A gas is introduced from the gas supply means 3 into the cavity of the mold M1 through the gas-introducing opening 41*a*, to increase pressure (dynamic pressure) in the cavity, so that the melt m poured into the cavity of the mold M1 is pushed by the gas into the product cavity portion of the mold M1 for forming a cast product. After the gas-introducing opening 41*a* is connected to the sprue s1, the distance between the nozzle-attaching/detaching means 21*b* and the mold M1 is measured by a laser distance meter (not shown), a mold-position-measuring means mounted to the nozzle-attaching means 21*b*, while introducing a gas. This measurement is conducted while the gas-introducing opening 41*a* is connected to the sprue s1.

Figure 4:
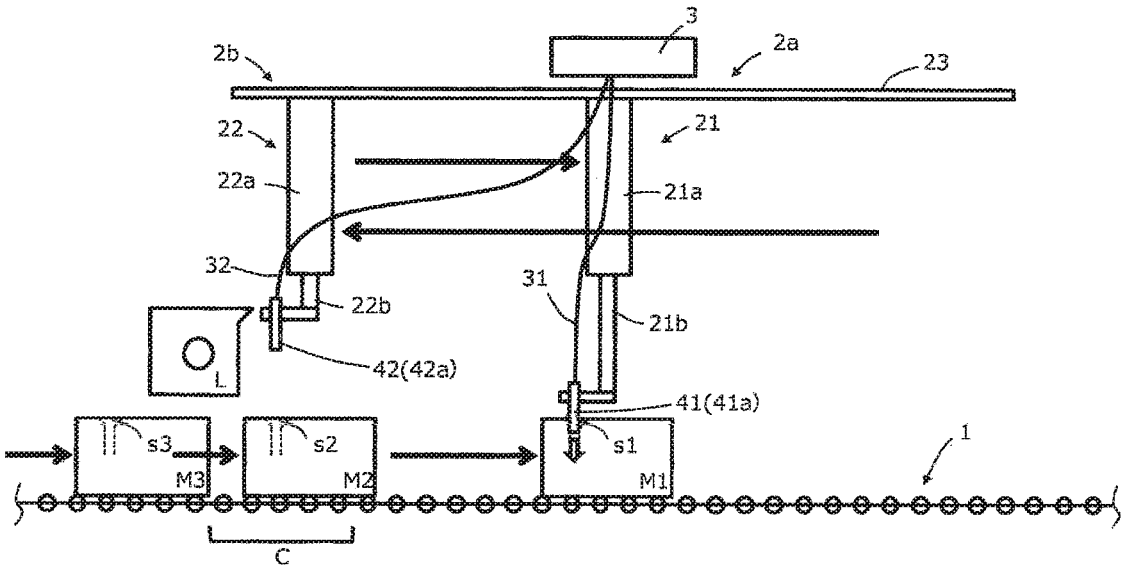
FIG. 4 is a schematic view showing the casting apparatus of the present invention, which is operated from the state of FIG. 3.

As shown in FIG. 4, the moving means 21*a* of the gas supply unit 2*a* is then moved downstream together with the mold M1 which is conveyed downstream from the pouring position by the mold-conveying means 1. During this downstream movement, the moving speed of the moving means 21*a* is controlled, such that the value measured by the laser distance meter (mold-position-measuring means) is kept within a desired range to a predetermined value (for example, the measured value immediately before conveying the mold, namely the measured value just when the gas-introducing opening 41*a* is connected to the sprue s1). Thus, the moving means 21*a* can move following the mold M1, so that the gas-introducing opening 41*a* supported by the moving means 21*a* via the nozzle-moving means 21*b* can be moved while keeping its connection to the sprue s1 to introduce a gas (conveying step). As a result, even when inertia is applied to the gas-introducing opening 41*a* by increase or decrease of the moving speed of the mold M1, the gas-introducing opening 41*a* is not easily detached from the sprue s1, thereby avoiding gas leak and pressure decrease in the cavity.

In the above conveying step, the absolute value of acceleration of vertical vibration received by the mold M1 is preferably 19.6 $m/s^2$ or less. The absolute value of the above acceleration is preferably 9.8 $m/s^2$ or less, more preferably 4.9 $m/s^2$ or less, most preferably 2.0 $m/s^2$ or less. The mold M1 receiving small vertical conveying shock makes the gas-introducing opening 41*a* less detachable from the sprue s1, thereby further preventing gas leak and surely avoiding pressure decrease in the cavity. To reduce vertical vibration received by the mold M1, the mold-conveying means 1 should have a sufficiently high-rigidity structure, or a proper conveying profile is used, and so on.

The pushing reaction force when the gas-introducing opening 41*a* of the nozzle 41 is connected to the sprue s1 in the conveying step is set to 600 N or less. When it exceeds 600 N, the mold M1 or the nozzle 41 is more likely damaged. It is preferably 500 N or less. The lower limit of the pushing reaction force is not particularly restricted as long as the nozzle 41 is kept pushed against a reaction force when a gas is introduced into the sprue s1 through the nozzle 41, and it may be, for example, 50 N. A small absolute value of acceleration of vertical vibration received by the mold M1 preferably decreases the upper limit of the pushing reaction force, because it makes the gas-introducing opening 41*a* less detachable from the sprue s1 as described above. The upper limit of the pushing reaction force may be, for example, 360 N when the acceleration of vertical vibration (absolute value) received by the mold M1 is 19.6 $m/s^2$ or less, or 250 N when it is 2.0 $m/s^2$ or less.

After the melt completely is poured into the cavity of the mold M1, the moving means 21*a* of the gas supply unit 2*a* moves following the mold M1. Accordingly, the mold M1 is conveyed downstream while keeping the connection of the gas-introducing opening 41*a* to the sprue s1 to introduce a gas into the cavity of the mold M1. After the mold M1 departs from the melt-pouring area C, a mold M2 waiting upstream of the mold M1 is conveyed by the mold-conveying means 1 to the pouring position in the melt-pouring area C with a predetermined timing as shown in FIG. 4. A moving means 22*a* of a gas supply unit 2*b* is moved upstream along the rail 23 with a predetermined timing, and a gas-introducing opening 42*a* of a nozzle 42 supported by a nozzle-attaching/detaching means 22*b* is moved to a position above the mold M2.

Figure 5:
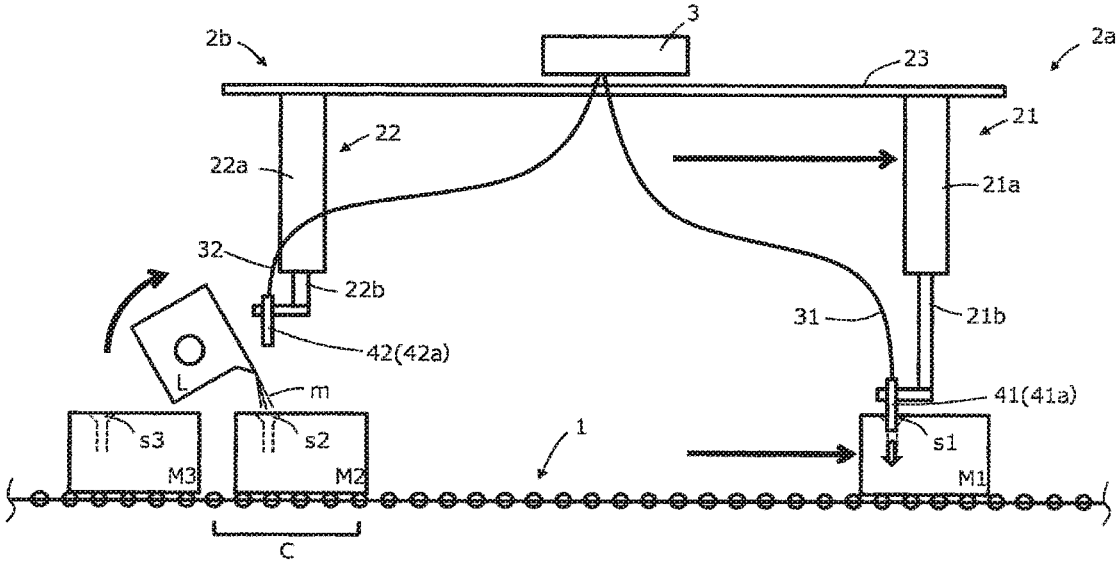
FIG. 5 is a schematic view showing the casting apparatus of the present invention, which is operated from the state of FIG. 4.

As shown in FIG. 5, the mold M1 is further conveyed downstream by the mold-conveying means 1, and the moving means 21*a* of the gas supply unit 2*a* moves following the mold M1 to keep the introduction of a gas into the cavity of the mold 1. During conveying the mold M1, the ladle L is inclined at the pouring position in the melt-pouring area C, to pour a melt m in an amount less than the volume of the entire cavity of the mold M2 and equal to or more than the volume of the product cavity portion, into the cavity of the mold M2.

Figure 6:
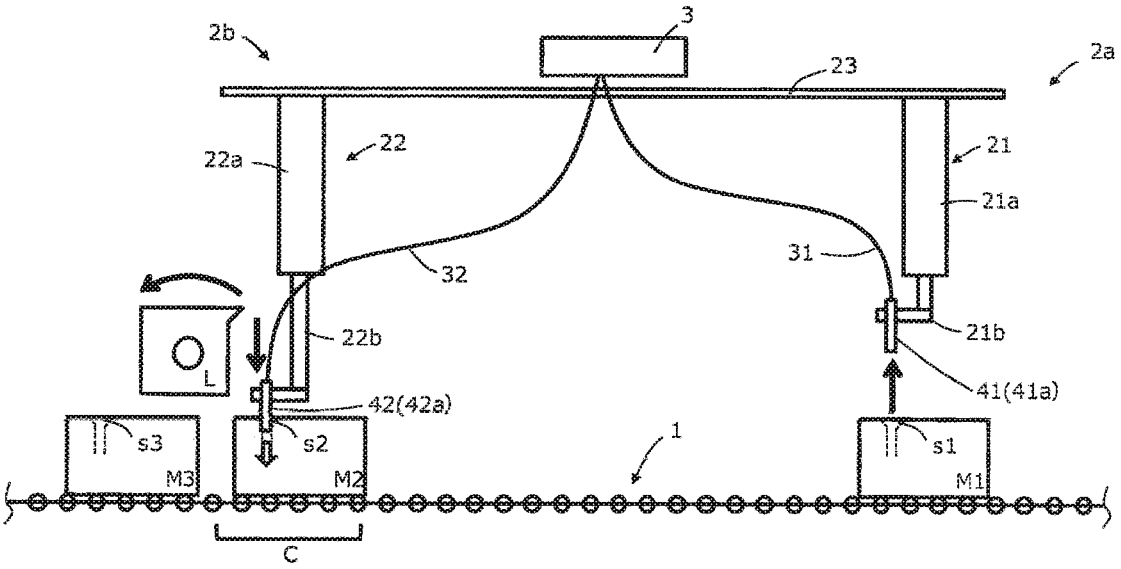
FIG. 6 is a schematic view showing the casting apparatus of the present invention, which is operated from the state of FIG. 5.

As shown in FIG. 6, the mold M1 is then stopped at a predetermined position by the mold-conveying means 1. When the fluidity of the melt filling the desired cavity portions of the mold M1 including the product cavity portion is lowered to such a level that the melt is not reversed, the nozzle-attaching/detaching means 21*b* of the gas supply unit 2*a* is elevated to withdraw the nozzle 41 from the mold M1, thereby detaching the gas-introducing opening 41*a* from the sprue s1 (detaching step). Though a gas from the gas supply means 3 may be stopped at the timing of detaching, the gas supply may be stopped when the fluidity of a melt filling the desired cavity portions of the mold M1 including the product cavity portion is lowered to such a level that the melt is not reversed, and the gas-introducing opening 41*a* may be then detached from the sprue s1. Thereafter, the mold M1 is conveyed to the downstream side by the mold-conveying means 1 (see FIG. 7).

The detaching step can be conducted anytime after the desired cavity portions including the product cavity portion are filled with a melt by the introduced gas, and it can also be conducted without stopping the mold M1. However, to prevent product defects such as underfills generated by the reverse flow of a melt, it is desirable to keep introducing the gas from the gas-introducing opening 41*a* into the cavity of the mold M1 even after the completion of charging the melt, until the melt filling the desired cavity portions of the mold M1 including the product cavity portion by a gas as described above is cooled to such a level that the fluidity of the melt is lowered to prevent at least the reverse flow, and then conduct the detaching step.

Figure 7:
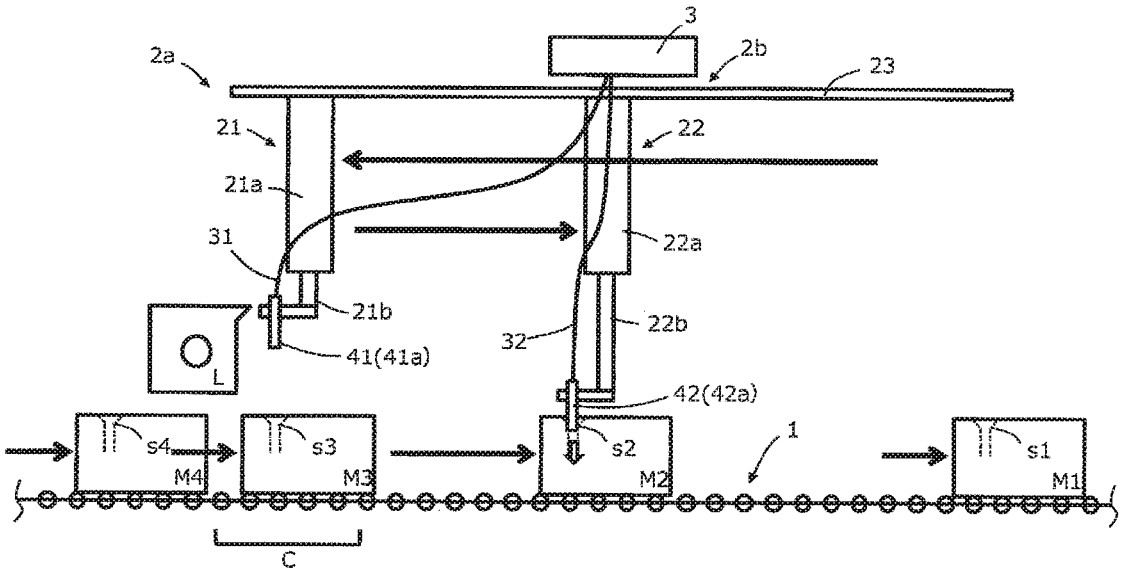
FIG. 7 is a schematic view showing the casting apparatus of the present invention, which is operated from the state of FIG. 6.

As shown in FIG. 6, the nozzle-attaching/detaching means 22*b* of the gas supply unit 2*b* is moved downward to connect the gas-introducing opening 42*a* of the nozzle 42 to the sprue s2 of the mold M2 (connecting step). A gas is then introduced from the gas supply means 3 into the cavity of the mold M2 through the gas-introducing opening 42*a*, to pressurize the cavity of the mold M2. As a result, the melt m poured into the mold M2 is charged into the product cavity portion of the mold M2. Also, the measurement of the distance from the nozzle-attaching/detaching means 22*b* to the mold M2 by a laser distance meter (not shown) attached as a mold-position-measuring means to the nozzle-attaching/detaching means 22*b* is started after the gas-introducing opening 42*a* is connected to the sprue s2. This measurement is continued while the gas-introducing opening 42*a* is connected to the sprue s2. As shown in FIG. 7, the mold M2 also undergoes the conveying step and the detaching step after the connecting step, like the mold M1. Following the mold M2, the above connecting, conveying and detaching steps are repeated using the gas supply unit 2*a* for a mold M3 being conveyed, and the gas supply unit 2*b* for a mold M4 following the mold M3.

As described above, the casting method of the present invention continuously conducts melt pouring and conveying, by repeating the connecting, conveying and detaching steps explained referring to FIGS. 1-7 for successively conveyed molds M1, M2, . . . . Namely, the casting method of the present invention is a casting method of successively conveying melt-poured molds from the melt-pouring area, to which a gas-introducing casting method is applied, enabling the mass production of castings having good quality while reducing the amount of a melt necessary for casting.

Though the casting apparatus and the casting method using it according to the embodiments of the present invention have been explained above, the present invention is not restricted to the casting apparatus and the casting method using it in the above embodiments, but may be changed within the scope of the claims. For example, the movement of the molds M1, M2, . . . and the movement of two sets of gas supply units 2*a*, 2*b* may be changed.

What is claimed is:

1. A casting apparatus for producing castings using molds each having a sprue, comprising a mold-conveying means for conveying molds each containing a melt poured through said sprue;

nozzles each having a gas-introducing opening attachable to and detachable from said sprue;

a multi-axis, multi joint robot, wherein the multi-axis, multi joint robot vertically moves each nozzle to attach and detach said gas-introducing opening to and from said sprue, and wherein the multi-axis, multi joint robot engages a rail which horizontally extends above the mold-conveying means and horizontally moves following a mold conveyed by said mold-conveying means, while keeping the connection of said gas introducing opening to said sprue; and a gas supply means connected to each nozzle for supplying a gas to said gas-introducing opening, wherein said nozzle is connected to said multi-axis, multi joint robot, via a universal joint elastically displaceable in a direction of conveying said molds by said mold-conveying means.

2. The casting apparatus according to claim 1, wherein a nozzle-position-detector capable of detecting the displacement of said nozzle by said universal joint is mounted to said multi-axis, multi joint robot, to control the movement of said multi-axis, multi joint robot such that the position of the nozzle detected by said nozzle-position-detector is within a predetermined range from a reference position.

3. The casting apparatus according to claim 1, which comprises pluralities of gas supply units each constituted by a set of said nozzle and said multi-axis, multi joint robot.

4. The casting apparatus according to claim 3, wherein said molds are successively conveyed by said mold-conveying means, and each of said gas supply units is successively operated for each of said molds.

5. The casting apparatus according to claim 1, further comprising a melt-surface-detecting means for detecting the lowered degree of a surface of a melt poured through said sprue; said gas-introducing opening being connected to said sprue when the lowered surface level detected by said melt-surface-detecting means exceeds a threshold value.

6. A casting method for producing castings using the casting apparatus of claim 1, comprising a step of providing the casting apparatus of claim 1;

a step of connecting said gas-introducing opening to a sprue of a mold into which a melt has been poured;

a step of conveying the mold to which said gas-introducing opening is connected, while introducing a gas into the mold through said gas-introducing opening; and a step of detaching said gas-introducing opening from the sprue;

wherein in said conveying step, said gas-introducing opening connected to said sprue moves following the mold being conveyed.

7. The casting method according to claim 6, wherein in said connecting step, said gas-introducing opening is connected to said sprue after a surface of said melt poured through said sprue is lowered to a predetermined height.

8. The casting method according to claim 6, wherein the absolute value of acceleration of vertical vibration received by said mold is 19.6 $m/s^2$ or less in said conveying step.

9. The casting method according to claim 6, wherein a reaction force generated by pushing said gas-introducing opening to said sprue for connection in said conveying step is 600 N or less.

* * * * *